United States Patent [19]

Gerrish

[11] 4,029,158

[45] June 14, 1977

[54] PILE DRIVING APPARATUS

[75] Inventor: Arthur Gerrish, Burgess Hill, England

[73] Assignee: Laser Engineering Development Ltd., London, England

[22] Filed: Aug. 4, 1975

[21] Appl. No.: 601,433

[30] Foreign Application Priority Data

Aug. 9, 1974 United Kingdom ..... 35192/74

[52] U.S. Cl. ..... 173/131; 61/53.5; 173/139; 267/113

[51] Int. Cl.[2] ..... E02D 11/00

[58] Field of Search ..... 175/19; 310/8, 8.5, 310/5; 252/75; 267/113, 116; 173/131; 61/53.5

[56] References Cited

UNITED STATES PATENTS

| | | | |
|---|---|---|---|
| 2,886,151 | 5/1957 | Winslow | 252/75 UX |
| 3,270,672 | 9/1966 | Haines et al. | 310/8 |
| 3,304,446 | 2/1967 | Martinek et al. | 252/75 X |
| 3,797,585 | 3/1974 | Ludvigson | 175/19 X |

*Primary Examiner*—Ernest R. Purser
*Assistant Examiner*—William F. Pate, III

[57] ABSTRACT

Apparatus for use in driving a pile by means of successive hammer blows at the same time as a vibratory force is to be applied to the pile comprises means for simultaneously transmitting, to a pile to be driven, a force produced by a hammer blow and a vibrating force which is generated by the application of the hammer blow. Preferably the apparatus comprises a housing including an elongate enclosed chamber containing an electro viscous fluid, the housing being adapted to be mounted on the upper end of a pile to be driven with the chamber longitudinally orientated in the direction in which the pile is to be driven; a transfer hammer having a part which slidingly extends into the chamber through the housing for transmitting the force produced by a hammer blow applied to the transfer hammer to the pile to be driven by movement of said part of the transfer hammer into the chamber along the length of the chamber; and means for developing a vibratory force when the said part of the transfer hammer moves along the chamber as a result of a hammer blow, said means comprising a gap containing said electro viscous fluid surrounding the said part of the transfer hammer between said part of the transfer hammer and the walls of the chamber and means for applying an alternating electrical field across the gap.

11 Claims, 3 Drawing Figures

PILE DRIVING APPARATUS

FIELD OF THE INVENTION

This invention relates to pile driving apparatus, and particularly to apparatus where a vibratory force is applied to a pile as it is driven by successive hammer blows.

BACKGROUND OF THE INVENTION

Previously vibration forces used in pile driving have been applied usually in a longitudinal direction, but sometimes laterally to assist penetration under the weight of the pile when a steady force is applied, and also alternating with the hammer blows. Prior proposals involve the use of mechanical vibration, induced by out-of-balance weights with some provision for harmonics but not truly a variable frequency. The frequency used is based on pile resonance which is a relatively low frequency. There are other factors involved that affect optimum frequency such as particle size of soil to be penetrated and degree of compaction and it is desirable that the applied vibration should have a variable frequency capability.

A variable vibrator on the basis of a closed loop electrohydraulic control valve has been developed for pile driving and applied with some degree of success to dry and sea bed pile driving, using alternately vibration and hammer driving.

The limitation of this system is that it can produce a maximum frequency of 100–150 Hz and requires a very high powered hydraulic pumping system having a capacity in the range of 250 horsepower to possible over 1000 horsepower for North Sea oil applications. Moreover, there is a tendency for the particles to become compacted during the vibration phase, thus reducing the penetration rate during the hammer phase.

SUMMARY AND OBJECTS OF THE INVENTION

According to the present invention there is provided pile driving apparatus comprising means for simultaneously transmitting, to a pile to be driven, a force produced by a hammer blow and a vibrating force which is generated by the application of the hammer blow.

The simplicity of this arrangement is that no secondary mechanical or hydraulic power source is required in the generation of the vibrating force, and the apparatus has the advantage that variable frequencies higher than those produced by previously proposed systems can be produced.

Preferably, the pile driving apparatus comprises a housing including an elongate enclosed chamber containing an electro viscous fluid, the housing being adapted to be mounted on the upper end of a pile to be driven with the chamber longitudinally orientated in the direction in which the pile is to be driven; a transfer hammer having a part which slidingly extends into the chamber through the housing for transmitting, the force produced by a hammer blow applied to the transfer hammer to the pile to be driven by movement of said part of the transfer hammer into the chamber along the length of the chamber; and means for developing a vibratory force when the said part of the transfer hammer moves along the chamber as a result of a hammer blow, said means comprising a gap containing said electro viscous fluid surrounding the said part of the transfer hammer between said part of the transfer hammer and the walls of the chamber and means for applying an alternating electrical field across the gap.

Means may be provided for accommodating fluid which is displaced as a result of said movement of the transfer hammer into the chamber. Preferably, a space is provided in the chamber above the level of fluid in the chamber.

Preferably resilient means are provided for urging the transfer hammer into an inoperative position from which it can move into the chamber as aforesaid as a result of a hammer blow against the action of said resilient means. The resilient means may comprise a compression spring. Additionally or alternatively, the resilient means may include a resilient gas-filled enclosure which is arranged to be resiliently compressed by said movement of the transfer hammer into the chamber as a result of a hammer blow, or a liquid spring.

In one embodiment of the invention, the means for developing a vibratory force comprise an electro viscous valve constituted by said gap, through which fluid flows when the said part of the transfer hammer moves as aforesaid. In this case, the vibratory force is derived from the resultant alternating pressure differential along the valve.

Alternatively, passageways may be provided in the said part of the transfer hammer for the passage of fluid therethrough when the said part moves into the chamber as aforesaid, said means for developing a vibratory force being arranged to develop force from the applied voltage and the shear induced in the field within the gap by the relative movement of the chamber walls and the said part of the transfer hammer.

The invention includes pile driving apparatus as described in the preceding paragraphs in combination with a pile to be driven, the apparatus being mounted on the upper end of the pile.

Reference will hereinafter be made to the accompanying drawings which illustrate, by way of example, various embodiments of the invention, and of which:

DESCRIPTION OF PREFERRED EMBODIMENTS

Figure 1:
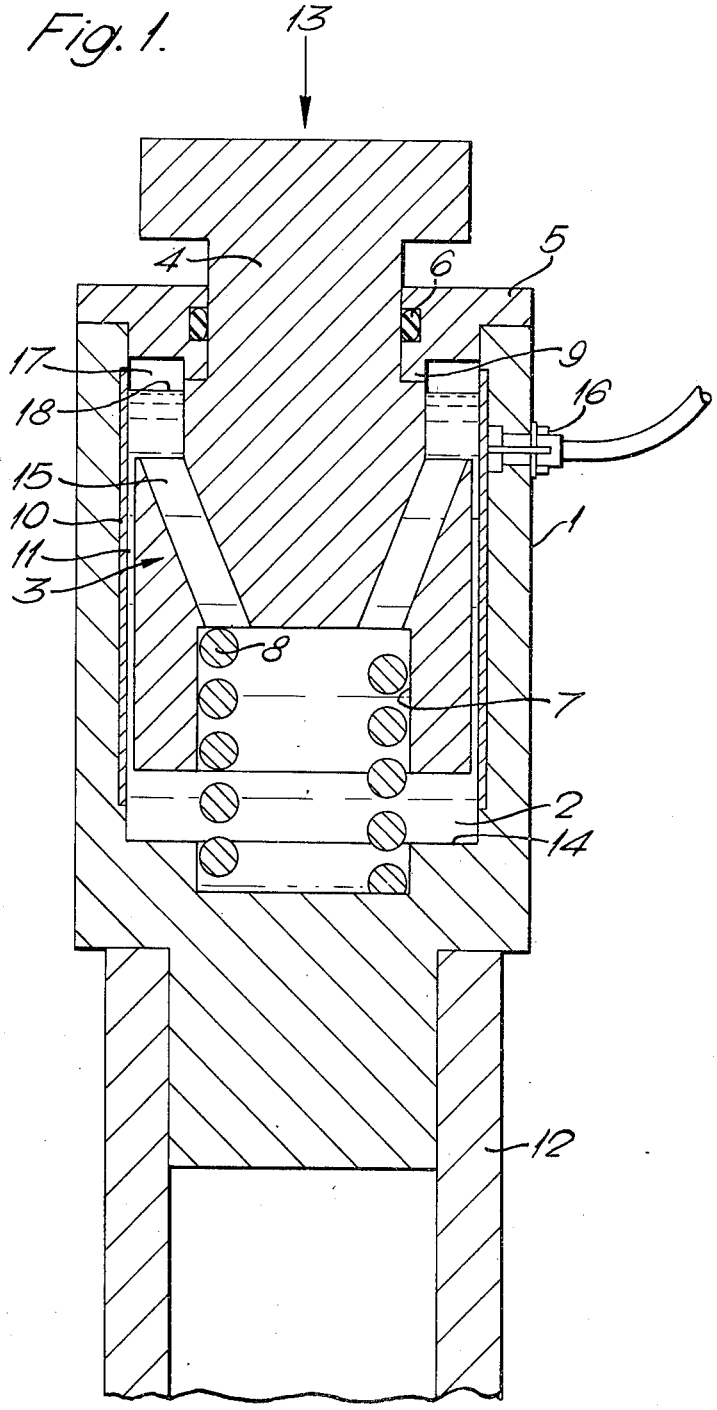
FIG. 1 shows a diagrammatic cross-sectional view of one embodiment of pile driving apparatus according to the invention, mounted on the upper end of a pile to be driven.

Referring to FIG. 1, a housing 1 includes an elongate cylindrical chamber 2 open at one end, which contains an electro viscous fluid. A transfer hammer 3 is disposed within the chamber 2 for axial movement therein, the hammer 3 having a part 4 which slidingly extends through a cap 5 which closes off the open end of the chamber 2. A suitable seal 6 is provided around the part 4. The end of the transfer hammer located within the chamber is formed with a blind bore 7, within which is seated a compression spring 8 for biasing the transfer hammer 3 towards the cap 5 into engagement with a stop 9 on the inner surface of the cap. An annular electrode 10 is fitted to the side wall of the chamber 2, so as to surround the transfer hammer 3 and leave a relatively narrow annular gap 11 between the transfer hammer and the electrode 10.

The housing 1 is fitted into the upper end of a pile 12 which is to be driven in the direction of an arrow 13. When a hammer blow is applied to the transfer hammer part 4 in the direction of arrow 13, the transfer hammer 3 moves axially within the chamber 2 away from the stop 9 against the action of the spring 8, until the lower end of the transfer hammer 3 hits a stop 14 at the other end of the chamber, thus transmitting the force of the hammer blow to the pile. The movement of the transfer hammer creates a flow of displaced fluid through passages 15 in the hammer. If an AC voltage of a chosen frequency is applied to the electrode 10 via a terminal assembly 16, when the transfer hammer moves, mechanical vibration at that frequency is generated in the housing 1 and thus in the pile 12 also, due to the resultant alternating variations in viscosity of the fluid and hence the corresponding alternating variation in the electro viscous shear stress induced in the annular gap 11. Since the fluid flows through the passages 15, no actual fluid pressure is generated by the movement of the transfer hammer. After each hammer blow, the energisation of the electrode 10 is ceased to permit the transfer hammer to return to the position shown in the drawing in contact with stop 9 under the action of the spring 8.

In order to allow for the change in internal volume of the chamber 2 when the part 4 of the transfer hammer slides into the housing 1, the fluid does not completely fill the chamber 2, there being a space 17, preferably filled with gas, about the level 18 of the fluid. The position of the level 18 when the part 4 engages the stop 9 is chosen so that the decrease in internal volume produced when the part 4 moves towards stop 14 is accommodated by space 17 without excessive pressure rise in space 17.

Figure 2:
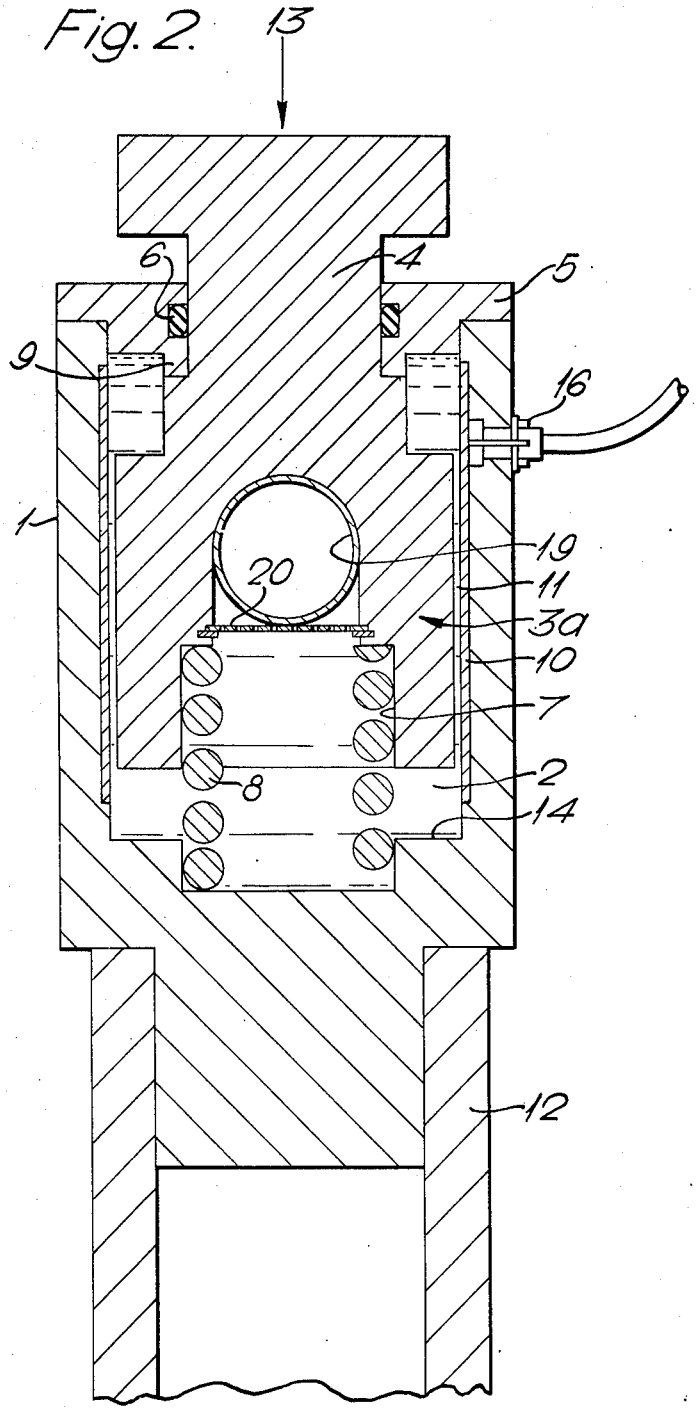
FIG. 2 shows a view similar to that of FIG. 1 of a modified version of the pile driving apparatus of FIG. 1.

A second embodiment of the invention, shown in FIG. 2, which provides for more effective transmission of relatively high forces than the apparatus of FIG. 1, uses a modified transfer hammer 3*a* which does not possess the passages 15, provided in the transfer hammer 3 in the apparatus of FIG. 1, the other features of the apparatus shown in FIG. 2 being substantially similar to those shown in FIG. 1 and identified by the same reference numerals. Since there are no passages through the transfer hammer 3*a*, all the fluid must pass through the gap 11, which now constitutes an electro viscous value, when the transfer hammer 3*a* moves towards stop 14. When flow commences, the electro viscous shear stress created by the applied AC voltage, and acting over the area of the electrode 10 is balanced against the pressure acting over the frontal peripheral area of the electrode flow path. For example, if D is the electrode diameter, $e$ is the gap width, L is the axial length of the electrode, $S_E$ is the electro viscous shear stress created over each shear face (i.e. each coaxial valve surface), and the developed pressure at the lower end of the transfer hammer is P, then $P \times \pi De = 2S_E \times \pi DL$, giving $P = 2S_E L/e$. Whilst the value of P is dependent on the force balance conditions over the gap 11, at the pressure P is exerted over the whole area of the transfer hammer 3*a*, producing a relatively large effective force gain. As in the embodiment shown in FIG. 1, the desired mechanical vibration is generated by energising the electrode 10 with an AC voltage at the chosen frequency, which can be readily altered to suit changed conditions during piling. The value of $S_E$ is a function of the applied voltage to the electrode 10, and hence by varying the voltage as well as its frequency, it is possible to control the developed pressure and thus also the remaining energy left for direct impact on stop 14, or to prevent such impact altogether.

With this second embodiment of the transfer hammer 3*a* does not necessarily hit stop 14 before the pile penetrations commences. Indeed all the external hammer energy may be used up in pile penetration or a mixture of pile penetration and transfer hammer movement without an impact on stop 14 occurring at all.

A resilient spherical enclosure member 19 is located within a correspondingly shaped extension formed at the inner end of the blind bore 7 in the transfer hammer 3*a*. The enclosure member is filled with gas, and is held within the bore by a perforated retainer 20. In this embodiment, the whole chamber 2 is filled with fluid, there being no gas-filled space left above the fluid level. Since the decrease in the internal volume, produced when the transfer hammer 3*a* moves into the chamber towards stop 14, is compensated by the partial collapsing of the enclosure member 19 as a result of the resultant increased fluid pressure.

When the transfer hammer 3*a* is permitted to return to its starting position in contact with stop 9 after each hammer blow, by the cessation of energisation of the electrode 10, the partially collapsed enclosure member 19 assists the spring 8 in providing the return force required to move the transfer hammer 3*a* due to the difference between the resultant gradual decrease in the pressure of the fluid in the chamber 2 and the gaseous pressure inside the enclosure member 19. It is possible to replace the spring 8 entirely by providing an enclosure member 19 containing gas at an appropriate pressure when the transfer hammer is in its rest position against stop 9, which is capable of providing a return force of the required magnitude after each hammer blow.

Figure 3:
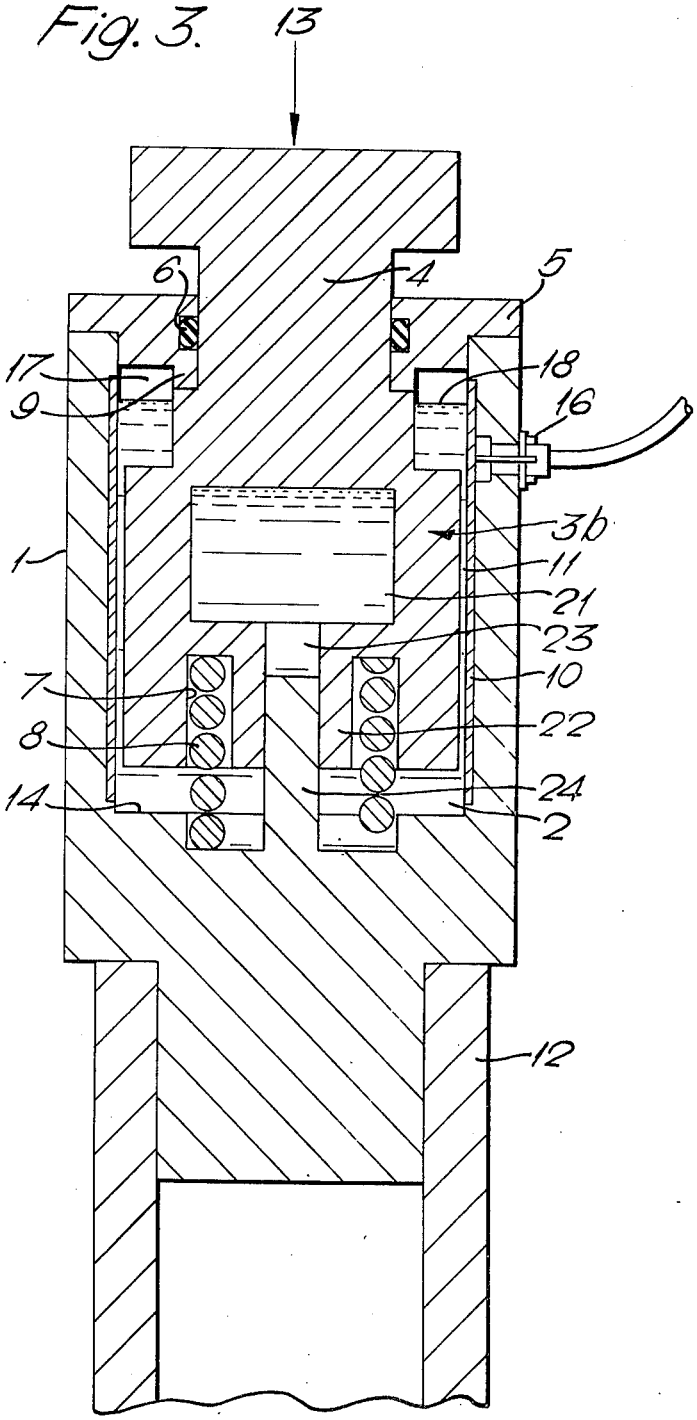
FIG. 3 shows a view similar to that of FIG. 2, of a second modified version of the pile driving apparatus of FIG. 1.

FIG. 3 shows another embodiment of the invention, which, like that shown in FIG. 1, includes a gas-filled space 17 above the fluid level 18 to allow for the changes in internal volume of the chamber described above, and in which the gap 11 constitutes an electro viscous valve as is the case in the apparatus shown in FIG. 2. Those parts of the apparatus shown in FIG. 3 which are substantially similar to corresponding parts shown in FIGS. 1 and 2 are identified by the same reference numerals.

Referring to FIG. 3, a modified transfer hammer 3*b* includes an internal chamber 21 which is preferably filled with liquid. A cylindrical projection 22, which extends from the inner end of the blind bore 7, includes a passageway 23 which leads from the end surface of the transfer hammer 3*b* to the internal chamber 21. A probe rod 24 formed integrally on the lower end wall of the chamber 2 is filled within the passage 23, so that, as the transfer chamber 3*b* moves into the chamber 2 as a result of a hammer blow, the projection 22 slides over the probe rod 24, with the liquid inside the chamber 21 separated by the probe rod 24 from the fluid in the chamber 2. Thus the probe rod 24 and the liquid-filled chamber 21 together form a liquid spring which can exert a return force on the transfer hammer when the latter is in its innermost position after a hammer blow, since as the transfer hammer 3*b* is moved downwards, the probe rod 24 compresses the fluid in chamber 21 in accordance with the bulk modules B of the fluid i.e. $\delta p = B\ \delta v/V$ where $\delta p$ is the pressure developed in chamber 21, V is the volume of chamber 21, and $\delta v$ is the cross-sectional area of the probe rod 24 multiplied by the distance through which the transfer hammer moves into the chamber 2. There are therefore four forces acting on the transfer hammer 3*b* at this time, namely the impact force due to a hammer blow in direction of arrow 13, electro viscous pressure force acting upwardly over the whole area of the transfer hammer 3*b*, the force produced by compression of coil spring 8 and the liquid pressure force developed by the pressure differential $\delta p$ applied over the area of the end of the probe rod 24. When voltage is applied the predominant force is the electro viscous pressure force. Both the coiled spring and the liquid spring are intended to return the transfer hammer to the top position when an input blow on 13 has been completed. During the return the AC voltage is of course removed from the electro viscous electrode.

The liquid spring may, in some cases, completely replace the coil spring 8, in which event the bore 7 is also omitted.

I claim:

1. Pile driving apparatus comprising a housing including an elongate enclosed chamber containing an electro viscous fluid, the housing being adapted to be mounted on the upper end of a pile to be driven with the chamber longitudinally orientated in the direction in which the pile is to be driven; and means for simultaneously transmitting, to a pile to be driven, a linear force produced by a hammer blow and a vibrating force which is generated by the application of the hammer blow, said means comprising a transfer hammer having a part which slidingly extends into the chamber through the housing for transmitting the linear force produced by a hammer blow applied to the transfer hammer to the pile to be driven by movement of said part of the transfer hammer into the chamber along the length of the chamber, and means for developing a vibratory force when the said part of the transfer hammer moves along the chamber as a result of a hammer blow, said means comprising a gap containing said electro viscous fluid surrounding the said part of the transfer hammer between said part of the transfer hammer and the walls of the chamber and means for applying an alternating electrical field across the gap.

2. Apparatus as claimed in claim 1, in which means are provided for accommodating fluid which is displaced as a result of said movement of the transfer hammer into the chamber.

3. Apparatus as claimed in claim 2, in which a gas-filled space is provided in the chamber above the level of fluid in the chamber.

4. Apparatus as claimed in claim 1, in which resilient means are provided for urging the transfer hammer into an inoperative position from which it can move into the chamber as aforesaid as a result of a hammer blow against the action of said resilient means.

5. Apparatus as claimed in claim 4, in which said resilient means includes a compression spring.

6. Apparatus as claimed in claim 4, in which the resilient means includes a resilient gas-filled enclosure which is arranged to be resiliently compressed by said movement of the transfer hammer into the chamber as a result of a hammer blow.

7. Apparatus as claimed in claim 4, in which the resilient means includes a liquid spring.

8. Apparatus as claimed in claim 1, in which the means for developing a vibratory force comprise an electro viscous valve constituted by said gap, through which fluid flows when the said part of the transfer hammer moves as aforesaid.

9. Apparatus as claimed in claim 1, in which passageways are provided in said part of the transfer hammer for the passage of fluid therethrough when the said part moves into the chamber as aforesaid, said means for developing a vibratory force being arranged to develop force from the applied voltage and the shear induced in the fluid within the gap by the relative movement of the chamber walls and the said part of the transfer hammer.

10. Pile driving apparatus as claimed in claim 1, in combination with a pile to be driven, the housing being mounted on the upper end of the pile, with the chamber therein longitudinally oriented in the direction in which the pile is to be driven.

11. Pile driving apparatus comprising: housing means including an enclosed chamber means containing an electro viscous fluid means, the housing means being adapted to be mounted on the upper end of a pile to be driven with the chamber means oriented in the direction in which the pile is to be driven; and means for simultaneously transmitting, to a pile to be driven, a linear force produced by a hammer blow and a vibrating force which is generated by the application of the hammer blow, said means comprising transfer hammer means including a part which slidably extends into the chamber means through the housing means for transmitting the linear force produced by a hammer blow applied to the transfer hammer means to the pile to be driven by movement of said part of the transfer hammer means into the chamber means along the chamber means, and means for developing a vibratory force when the said part of the transfer hammer moves along the chamber means as a result of a hammer blow; said means for developing a vibratory force comprising a gap containing said electro viscous fluid means surrounding the said part of the transfer hammer between said part of the transfer hammer and the walls of the chamber means, and means for applying and alternating electrical field across the gap.

* * * * *